US012158044B2

(12) United States Patent
Rijzingen et al.

(10) Patent No.: US 12,158,044 B2
(45) Date of Patent: Dec. 3, 2024

(54) ELEVATOR FOR HEAVY LOAD PIPE LIFTING, PIPE FOR SUCH ELEVATOR AND PIPE HANDLER ASSEMBLY COMPRISING SUCH ELEVATOR

(71) Applicant: National Oilwell Varco Norway AS, Kristiansand S (NO)

(72) Inventors: Johannes Wilhelmus Henricus van Rijzingen, Oosterhout (NL); Andrei Muradov, Houston, TX (US)

(73) Assignee: Grant Prideco, Inc., Houston, TX (US)

( * ) Notice: Subject to any disclaimer, the term of this patent is extended or adjusted under 35 U.S.C. 154(b) by 181 days.

(21) Appl. No.: 17/592,262

(22) Filed: Feb. 3, 2022

(65) Prior Publication Data

US 2022/0268111 A1 Aug. 25, 2022

(51) Int. Cl.
*E21B 19/06* (2006.01)

(52) U.S. Cl.
CPC ..... *E21B 19/06* (2013.01)

(58) Field of Classification Search
CPC ..... E21B 19/06
USPC ..... 166/77, 51
See application file for complete search history.

(56) References Cited

U.S. PATENT DOCUMENTS 2,053,284 A 9/1936 Grau
6,349,764 B1 2/2002 Adams
7,497,268 B1 * 3/2009 Zeni ..... E21B 19/06 294/90
2005/0099004 A1 * 5/2005 Bouey ..... F16L 33/224 285/249
2015/0247367 A1 * 9/2015 Angelle ..... E21B 19/07 166/380
2015/0361737 A1 12/2015 Foley
2020/0141195 A1 * 5/2020 Friestad ..... E21B 19/155

FOREIGN PATENT DOCUMENTS

WO 2010144184 12/2010

OTHER PUBLICATIONS

European Search Report for EP 21158969 dated Aug. 6, 2021 (2 pages).

* cited by examiner

*Primary Examiner* — Tara Schimpf
*Assistant Examiner* — Patrick F Lambe
(74) *Attorney, Agent, or Firm* — Conley Rose, P.C.

(57) ABSTRACT

Disclosed is an elevator for holding and end portion of a pipe in a drill tower. The elevator includes a hole from which, in operational use, an end portion of the pipe is suspended. The minimum diameter of the end portion of the pipe is selected larger than the minimum diameter of the hole, wherein sidewalls of the hole are shaped with a receiving surface for receiving correspondingly-shaped sidewalls of the end portion of the pipe. Similarly, sidewalls of the end portion of the pipe are shaped with an engagement surface for engagement with correspondingly-shaped sidewalls of the hole. Both the receiving surface and the engagement surface includes a first part and a second part neighbouring the first part, the first part defining a frustoconical shape having a first conicity, and the second part defining a shape having at least partially a second conicity lower than the first conicity.

10 Claims, 10 Drawing Sheets

ELEVATOR FOR HEAVY LOAD PIPE LIFTING, PIPE FOR SUCH ELEVATOR AND PIPE HANDLER ASSEMBLY COMPRISING SUCH ELEVATOR

CROSS REFERENCE TO RELATED APPLICATIONS

This present application claims benefit of European Patent Application No. 21158969.2 filed Feb. 24, 2021 and entitled "Elevator for Heavy Load Pipe Lifting, Pipe for Such Elevator and Pipe Handler Assembly Comprising Such Elevator", which is incorporated herein by reference in its entirety for all purposes.

STATEMENT REGARDING FEDERALLY SPONSORED RESEARCH OR DEVELOPMENT

Not applicable.

FIELD OF THE DISCLOSURE

The disclosure relates to an elevator for holding an end portion of a pipe in a drill tower. The disclosure further relates to a pipe configured for use with the elevator. The disclosure also relates to a pipe handler assembly comprising such elevator and pipe BACKGROUND OF THE DISCLOSURE Drill towers generally comprise a pipe handler assembly for handling drill pipes or other tubular structures. An important part of the pipe handler assembly is the elevator, which basically comprises a passive mechanical part that comprises a hole from which the pipe is suspended. The pipe conventionally has a thickened end portion having a diameter that is larger than a minimum diameter of the hole of the elevator. The hole is conventionally provided with an elevator bushing in order to be able to adapt the elevator to different diameters of the pipe. This bushing is suspended from the hole of the elevator and the end portion of the pipe is suspended from the elevator bushing. The hole in the elevator bushing conventionally comprises sidewalls that define a frustoconical shape, which matched a frustoconical part of the end portion between the thick end portion and the cylindrical middle part of the pipe. When a traditional pipe is suspended from the elevator bushing it forms an interface between the elevator and the pipe (i.e., drill pipe).

A traditional drill pipe-elevator interface features an 18-degree angle. The detailed description further illustrates this. This traditional design works very well for standard drill pipe sizes, i.e., 2⅜" (60.3 mm) through 6⅝" (168.3 mm), with standard wall thicknesses. However, for completion work over riser (CWOR) and Landing String (LS) applications, where the pipe is typically larger (6⅝" (168.3 mm) and larger) and wall thickness is greater (up to and, in some cases, over 1") the 18 degree angle induces excessive tangential (hoop) stresses in the pipe when the string weight nears the axial strength of the pipe. In view of this problem, there is a need to devise solutions that will not induce such stresses.

A solution that has been reported is an increased interface angle. A finite element analysis showed that a 45-degree angle is optimal in reducing the tangential stress component and balancing it with the axial stress.

The inventor of this patent application, however realized that this reported solution incorporating the 45-degree angle suffers from different problems.

Hence there is a need to further develop elevators and pipes.

SUMMARY OF THE DISCLOSURE

The inventor of this patent application realized that the interface having an increased angle, such as 45 degrees, reduces the available contact area resulting in excessive bearing stresses between the drill pipe elevator shoulder and the elevator bushing. This is explained in the detailed description below. Reducing the transition radius R between the axial pipe body and the pipe lifting shoulder (typically 1.5" (38.1 mm) would help, however it would increase the stress concentration in that transition radius which may adversely affect fatigue life of the pipe. An increased outside diameter (OD) of the tool joint is another consideration, however most power tongs (including Iron Roughnecks (IRN)) currently used in the field would not be able to handle such a large tool joint OD.

The present disclosure is intended to remedy or to reduce at least one of the drawbacks of the prior art, or at least provide a useful alternative to prior art.

In a first aspect, the disclosure relates to an elevator for holding an end portion of a pipe in a drill tower. The elevator has a hole from which, in operational use, the pipe is suspended with an end portion. A minimum diameter of the end portion of the pipe is selected larger than the minimum diameter of the hole. Furthermore, sidewalls of the hole are shaped with a receiving surface for receiving correspondingly-shaped sidewalls of the end portion of the pipe. In an embodiment, the receiving surface comprises a first part and a second part neighbouring the first part, the first part defining a frustoconical shape having a first conicity, the second part defining a shape having at least partially a second conicity lower than the first conicity.

The effects of the features of such elevator in accordance with the disclosure include the following. First of all, a key feature of the elevator is that the receiving surface comprises two parts having different shapes. The first part is still frustoconical, however the second part may be frustoconical, but does not need to be, as long as it at least partially has a conicity lower than the first part. An advantage of this configuration is that the first part may be designed for providing a large upward directed force with larger conicity, while the second part may be designed with a lower conicity to reduce stresses in the transition region. It must be stressed that, even though there are different shapes disclosed, this does not mean that the respective parts as mentioned in the claims are necessarily multiple objects connected together. On the contrary, both the elevator and the matching pipe are most likely made of one-piece to make it very strong.

In order to facilitate understanding of the disclosure one or more expressions are further defined hereinafter.

The wording "elevator" must be interpreted as a mechanical part, from which a pipe is suspended. The elevator function is in many applications provided by a system from which the elevator is suspended, such as a hoisting system in a drill tower.

The wording "pipe" must be interpreted as a tubular structure. In conventional drill tower applications in the petrochemical industry, these pipes are often drill pipes. However, the disclosure is not necessarily limited to drill pipes and elevators for those. The disclosure equally applies to other tubular structures (like casing and tubing), which suffer from similar problems as presented in this specification. Tubulars may be defined by the application. For example, if a drill pipe or casing is used for landing a liner or any other equipment in the well, it is usually called Landing String. Another example is Risers, (CWOR, etc.). The current disclosure covers all oil & gas tubulars irrespective of the specification they are manufactured to (drill pipe, casing, tubing) or the application (landing string, riser, etc.).

In an embodiment of the elevator according to the disclosure, the first conicity is such that sidewalls, in operational use, make an angle with a centreline of the pipe between 30 degrees and 60 degrees, preferably between 35 degrees and 55 degrees, even more preferably between 40 degrees and 50 degrees, and yet even more preferably about 45 degrees. The narrowing ranges in this group of embodiments indicate that the disclosure is not limited to a specific conicity, yet the optimal conicity may very well turn out to be around 45 degrees, which seems to balance the requirements the best in many cases.

In an embodiment of the elevator according to the disclosure, the second part of the receiving surface defines a thoroïde shape which transitions from the first conicity at a side facing the first part to the second conicity at an opposite side. The thoroïde shape which transitions from the first conicity to a lower conicity further reduces the stresses in the second part of the receiving surface of the elevator, but also in the second part of the engaging surface of the pipe.

In an embodiment of the elevator according to the disclosure, the second part of the receiving surface defines a further frustoconical shape. This embodiment forms an alternative to the thoroïde shape of the previous mentioned embodiment. Instead of a transitioning conicity in the second part, one might choose a constant second conicity yet being lower than the first conicity. This embodiment will be discussed in more detail with reference to FIG. 10.

In an embodiment of the elevator according to the disclosure, the second conicity is such that sidewalls, in operational use, at least locally make an angle with a centreline of the pipe between 14 degrees and 30 degrees, preferably between 15 degrees and 25 degrees, even more preferably between 16 degrees and 20 degrees, and yet even more preferably about 18 degrees. The narrowing ranges in this group of embodiments have shown to be best for preventing the pipe from becoming stuck in the elevator. In fact, a minimum angle of 14 degrees was calculated and the optimum second conicity has an angle of about 18 degrees according to the calculations.

In a second aspect, the disclosure relates to a pipe configured for use with the elevator described herein, wherein the pipe comprises the end portion, wherein, in operational use, the minimum diameter of the end portion of the pipe is selected larger than the minimum diameter of the hole of the elevator. Furthermore, sidewalls of the end portion are shaped with an engagement surface for engagement with correspondingly-shaped sidewalls of the hole. In at least some embodiments, the engagement surface comprises a first part and a second part neighbouring the first part, the first part defining a frustoconical shape having a first conicity, the second part defining a shape having at least partially a second conicity lower than the first conicity. The pipe of the second aspect matches the elevator of the first aspect. It must be stressed that the elevator and the pipe according to the disclosure belong together as a plug belongs to a socket. Both entities may be sold independently from each other and are therefore claimed as such in certain of the claims set out below.

In an embodiment of the pipe according to the disclosure, the first conicity is such that sidewalls make an angle with a centreline of the pipe between 30 degrees and 60 degrees, preferably between 35 degrees and 55 degrees, even more preferably between 40 degrees and 50 degrees, and yet even more preferably about 45 degrees. The narrowing ranges in this group of embodiments indicate that the disclosure is not limited to a specific conicity yet the optimal conicity may very well turn out to be around 45 degrees, which seems to balance the requirements the best in many cases.

In an embodiment of the pipe according to the disclosure, the second part of the engagement surface defines a thoroïde shape which transitions from the first conicity at a side facing the first part to the second conicity at an opposite side. The thoroïde shape which transitions from the first conicity to a lower conicity further reduces the stresses in the second part of the receiving surface of the elevator, but also in the second part of the engaging surface of the pipe.

In an embodiment of the pipe according to the disclosure, the second part of the engagement surface defines a further frustoconical shape. This embodiment forms an alternative to the thoroïde shape of the previous mentioned embodiment. Instead of a transitioning conicity in the second part, one might choose a constant second conicity yet being lower than the first conicity. This embodiment will be discussed in more detail with reference to FIG. 10.

In an embodiment of the pipe according to the disclosure, the second conicity is such that sidewalls at least locally make an angle with a centreline of the pipe between 14 degrees and 30 degrees, preferably between 15 degrees and 25 degrees, even more preferably between 16 degrees and 20 degrees, and yet even more preferably about 18 degrees. The narrowing ranges in this group of embodiments have shown to be best for preventing the pipe from becoming stuck in the elevator. In fact, a minimum angle of 14 degrees was calculated and the optimum second conicity has an angle of about 18 degrees according to the calculations.

An embodiment of the pipe according to the disclosure further comprises a transition part in between the second part and a cylindrical middle part of the pipe. The transition part may be designed as a thoroïde shape as well transitioning between an angle of 0 degrees (no conicity) at a side facing the cylindrical middle part of the pipe and the second conicity of the second part neighbouring the transition part.

In a third aspect the disclosure relates to a pipe handler assembly comprising an elevator in according to the disclosure, and further optionally comprising the pipe in accordance with the disclosure.

In a fourth aspect the disclosure relates to a drill tower comprising the pipe handler assembly according to the disclosure.

BRIEF DESCRIPTION OF THE DRAWINGS

In the following is described examples of embodiments illustrated in the accompanying figures, wherein.

DETAILED DESCRIPTION OF THE DISCLOSED EXEMPLARY EMBODIMENTS

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present subject matter will now be described with reference to the attached figures. Various systems, structures and devices are schematically depicted in the figures for purposes of explanation only and to not obscure the present disclosure with details that are well known to those skilled in the art. Nevertheless, the attached figures are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The disclosure will be discussed in more detail with reference to the figures.

Figure 1:
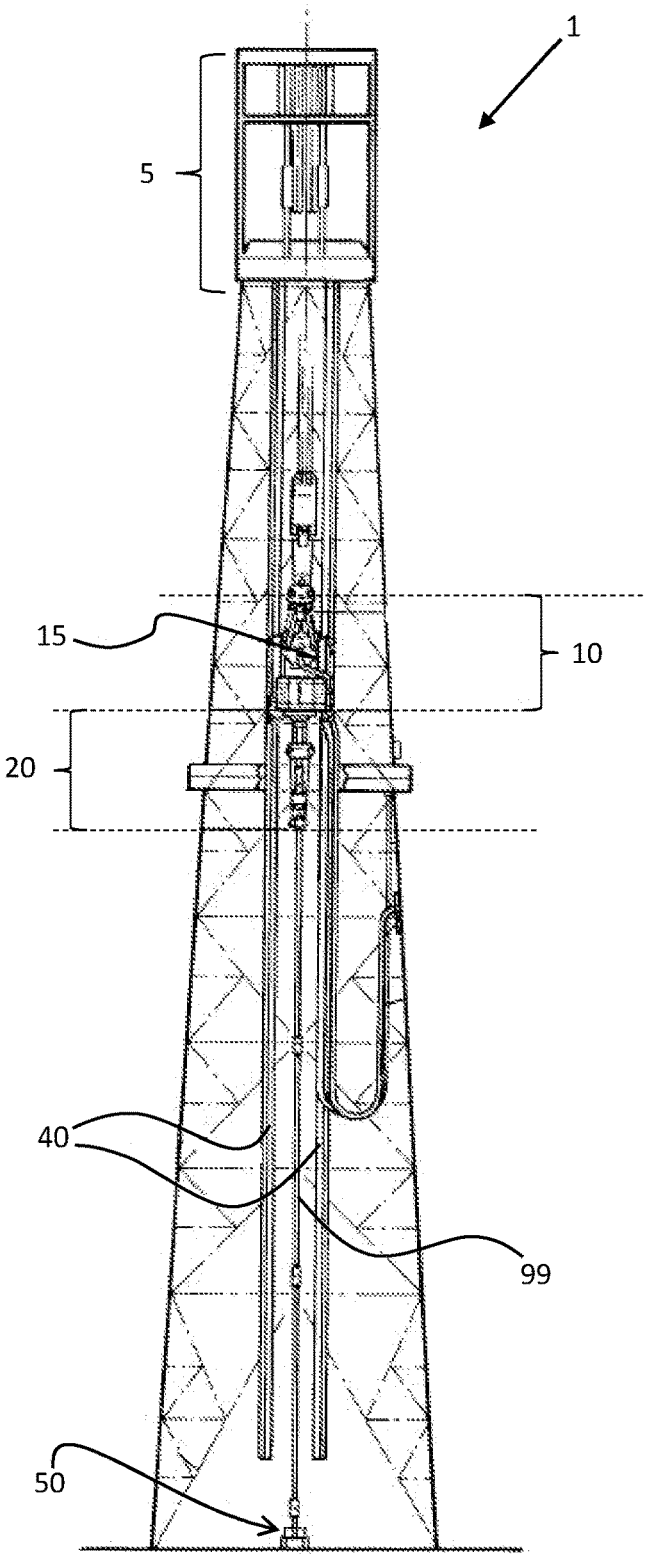
Fig. 1 (PRIOR ART
FIG. 1 shows a drill tower comprising a pipe handler assembly.

FIG. 1 shows a drill tower 1 comprising a pipe handler assembly 20. The drill tower 1 comprises a crown block 5 at the top, which typically comprises sheaves for guiding hoisting wires (not shown) that are fed from a winch (not shown) and run op to the sheaves of the crown block 5 and then down over to the top drive assembly 10, which comprises a standard swivel 15. The pipe handler assembly 20 is connected with the top drive assembly 10 as illustrated. The top drive assembly 10 may be hoisted up and down along guide rails 40.

During drilling operations, a drill pipe 99 is typically suspended from the pipe handler assembly 20, which runs down to a power slip 50 in the drill floor, as illustrated. The power slip 50 serves for holding the drill pipe 99 while drill pipe segments are being mounted or demounted from the drill pipe 99.

Figure 2:
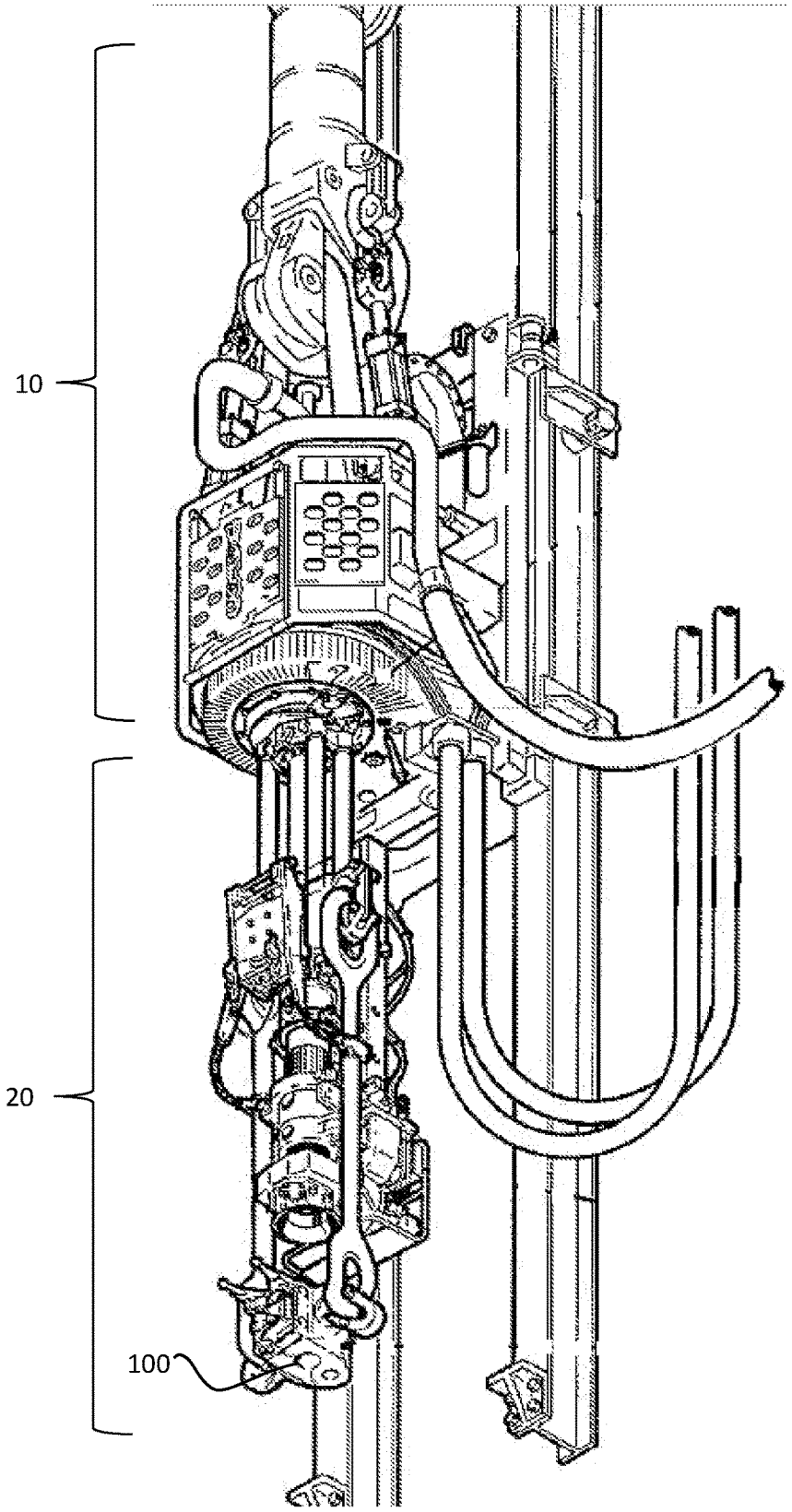
Fig. 2 (PRIOR ART)
FIG. 2 shows a perspective zoom view of a pipe handler assembly mounted to a top drive assembly.

FIG. 2 shows a perspective zoom view of a pipe handler assembly 20 mounted to a top drive assembly 10. In this figure the elevator 100 at the bottom side of the pipe handler assembly 20 is visible. This is the part of the drill tower 1 where the disclosure provides for an improvement.

Figures 3A, 3B:
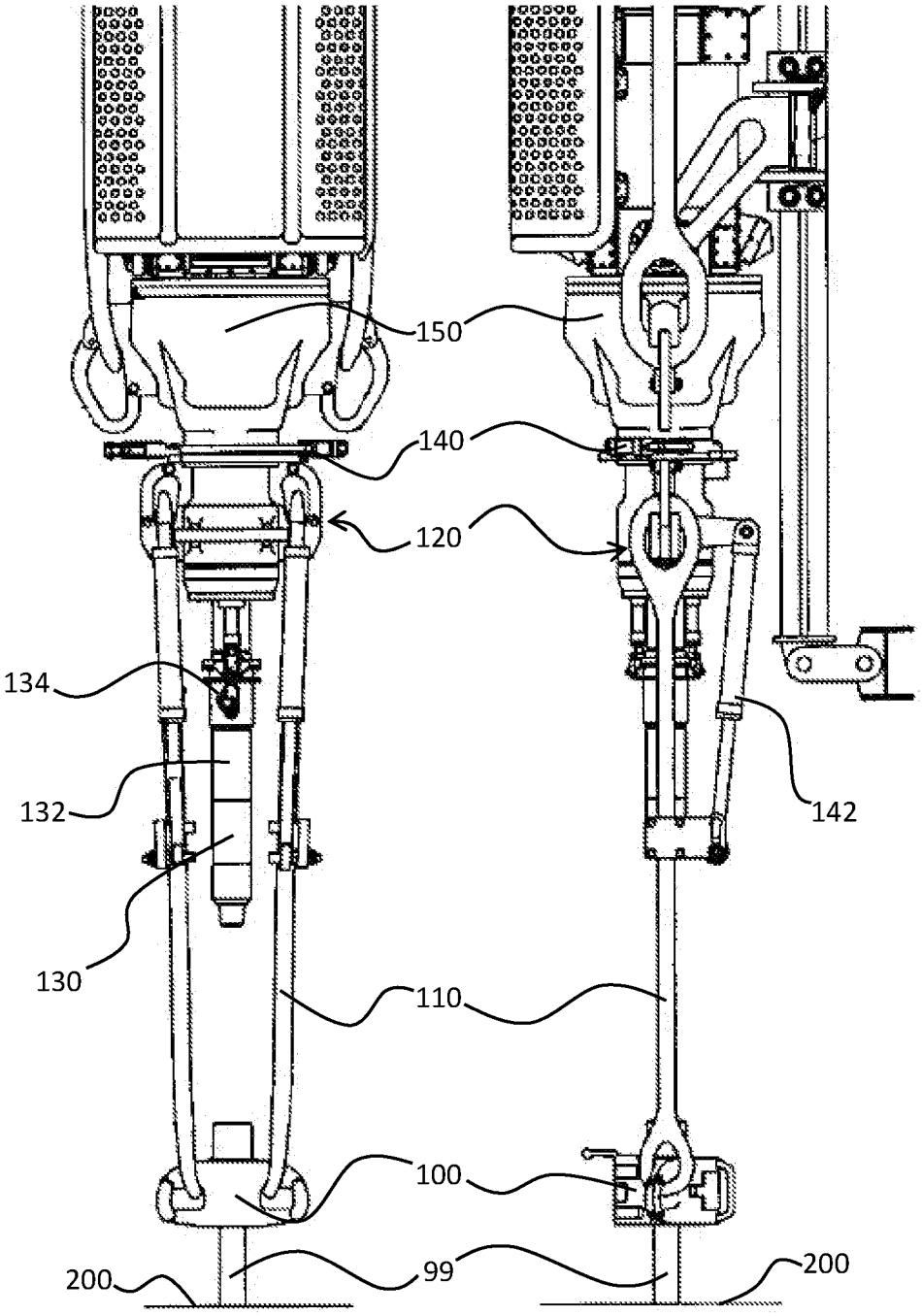
Fig. 3a (PRIOR ART)
Fig. 3b (PRIOR ART)
FIG. 3*a* shows a front view of part of the piper handler assembly and top drive assembly of FIG. 2.
FIG. 3*b* shows a side view of the same part as FIG. 3*a;*

FIG. 3*a* shows a front view of part of the piper handler assembly 20 and top drive assembly 10 of FIG. 2. FIG. 3*b* shows a side view of the same part as FIG. 3*a*. A drill pipe 99 protrudes from a drill floor 200 as illustrated. Its end portion hangs from the elevator 100, which will be discussed in more detail later with reference to other figures. The elevator 100 is suspended from a link adapter 120 via links 110 as illustrated. The link adapter 120 is connected with an elevator positioner 140, which on its turn is connected with a planetary drive train 150 (also referred to as top drive). The planetary drive train 150 may be coupled to the end portion of the drill pipe 99 via a series connection of different tools, including an upper IBOP with actuator 134, a lower inner blow out preventer (IBOP) 132 and an break sub 130, respectively. FIG. 3*b* also illustrates the tilt link 142 that serves for tilting the links 110 with the elevator 100 if needed.

Figure 4A:
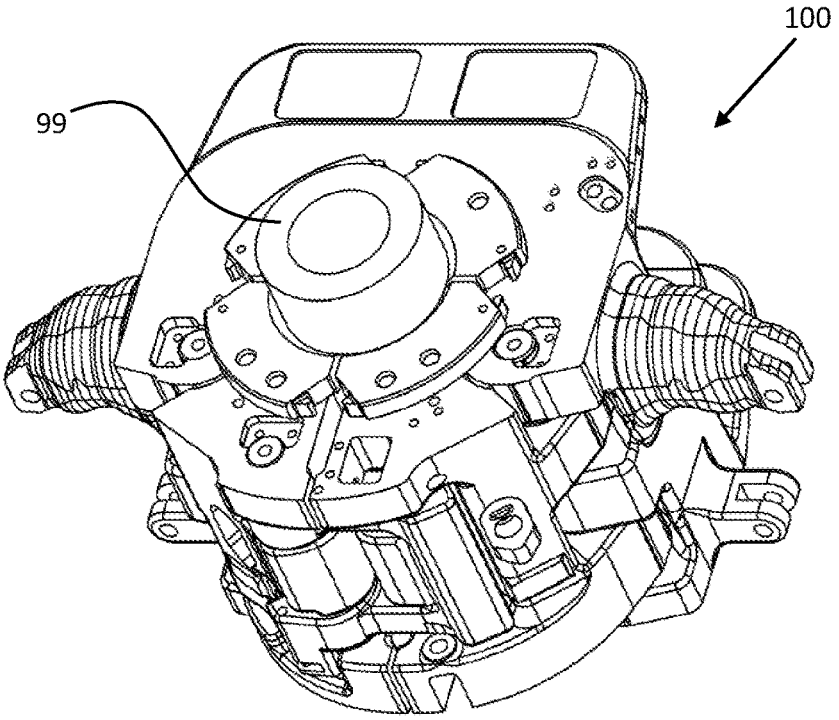
Fig. 4a (PRIOR ART)
FIG. 4*a* shows an elevator in which the disclosure may be applied.

FIG. 4*a* shows an elevator 100 that comprises a hole from which the drill pipe 99 is suspended.

Figure 4B:
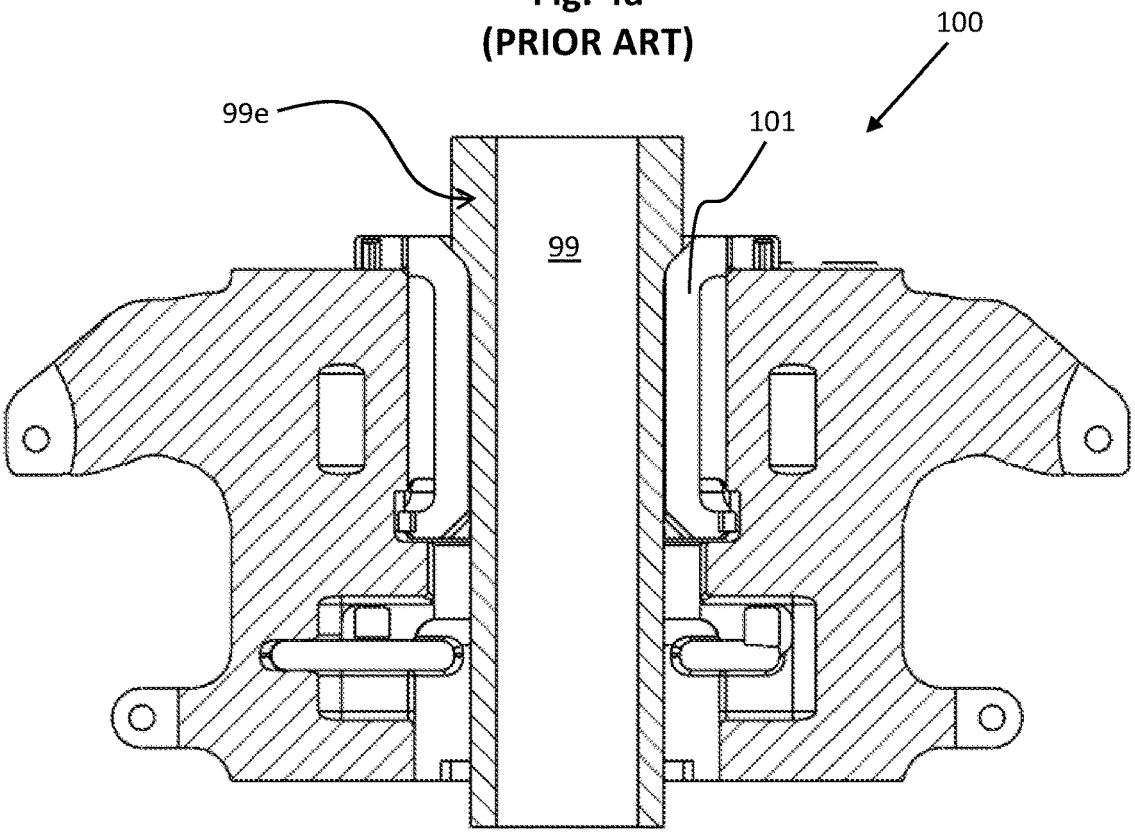
Fig. 4b (PRIOR ART)
FIG. 4*b* shows a cross-sectional view of the elevator of FIG. 4*a;*

FIG. 4*b* shows a cross-sectional view of the elevator 100 of FIG. 4*a*. This figure more clearly shows that the elevator 100 comprises an elevator bushing 101, from which the drill pipe 99 is suspended. In order to be able to suspend the drill pipe 99 from the elevator bushing 101 it is conventionally provided with an end portion 99*e*, which has larger diameter than a remaining section of the drill pipe 99, as illustrated. Even though the use of an elevator bushing 101 is quite common in the field, the elevator bushing could just as well be integrated with the elevator 100, as long as there is a hole in the elevator 100 from which the drill pipe 99 is suspended. Not all elevators have pipe specific bushings to support the pipe. Elevator bushings are used to dress an universal elevator for different sizes of pipe. There are also size specific elevators (suitable for one specific pipe only) which have the conical inner bore machined directly into the elevator. The disclosure is therefore not limited to bushing-elevators only.

It must be noted that there are many variations possible in the set-up and configuration of drill towers. The drill tower 1 presented in FIGS. 1-4*b* is just an example. The disclosure relates to any drill tower 1 having an elevator 100 from which drill pipes 99 are suspended.

Figure 5:
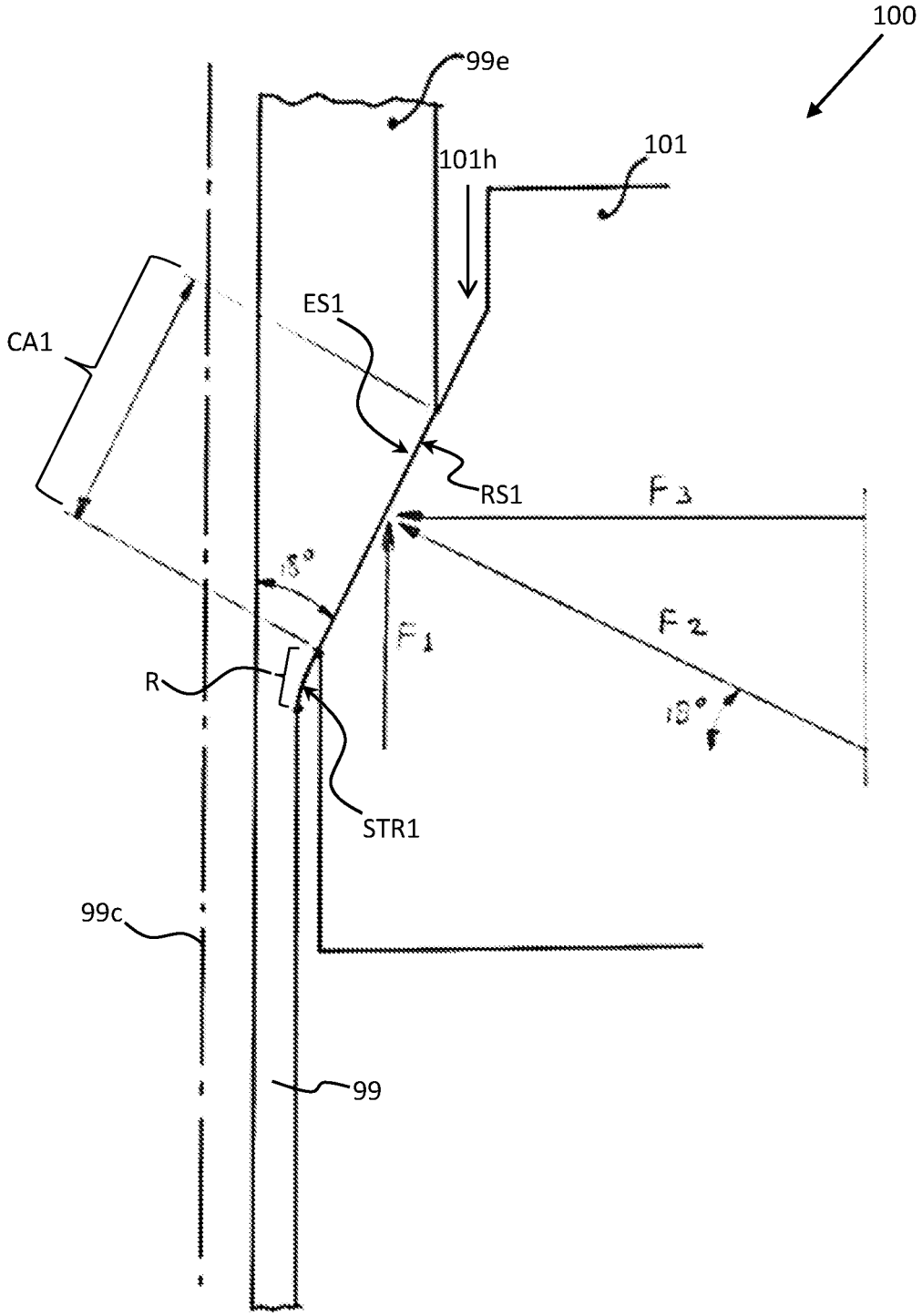
Fig. 5 (PRIOR ART)
FIG. 5 illustrates an elevator known from the prior art and an associated problem.

FIG. 5 illustrates a problem of an elevator 100 known from the prior art. The figure only shows a cross-sectional view of part of the elevator bushing 101 at the hole 101*h* from where the end portion 99*e* of the drill pipe 99 is suspended. The hole 101*h* of the elevator bushing 101 has a receiving surface RS1 that abuts an engagement surface ES1 at an interface between the elevator bushing 101 and the end portion 99*e* of the drill pipe 99. The centreline 99*c* of the drill pipe is also illustrated. It can be seen that the end portion 99*e* of the drill pipe 99 is provided with a frustoconical part that matches a shape of a corresponding part of the hole 101*h* of the elevator bushing 101. The conicity of the frustoconical part forms conventionally an angle of 18 degrees with centreline 99*c*. This angle is also referred to as "taper angle" in the prior art. This interface defines a contact area CA1 of a certain size as illustrate. It must be noted that this contact area CA1 stretches along the complete circumference of the hole 101*h* and the end portion 99*e* of the drill pipe 99. Adjacent to the frustoconical part of the end portion 99*e* there is a transition region R (which is also being referred to as the "radius" in this field of endeavour because it often follows a circular curvature), wherein the shape bends according to a circular with a certain radius (in the cross-sectional view). It can be seen that with a conicity (taper angle) of 18 degrees the transition region surface is relatively small, i.e., the middle section of the drill pipe remains very close to the sidewall of the elevator bushing, because of the low angle.

A severe disadvantage, however, is that a contact force F2 applied under this low angle of 18 degrees becomes very large. In fact, if the desired upward-directed force F1 is as illustrated, the contact force F2 is a 1/sin 18°=3.24 times the upward-directed force F1. Consequently, a radially-inward directed crushing force F3 is 1/tan 18°=3.14 times the upward-directed force F1. These crushing forces F3 may cause hoop stresses in the drill pipe.

Figure 6:
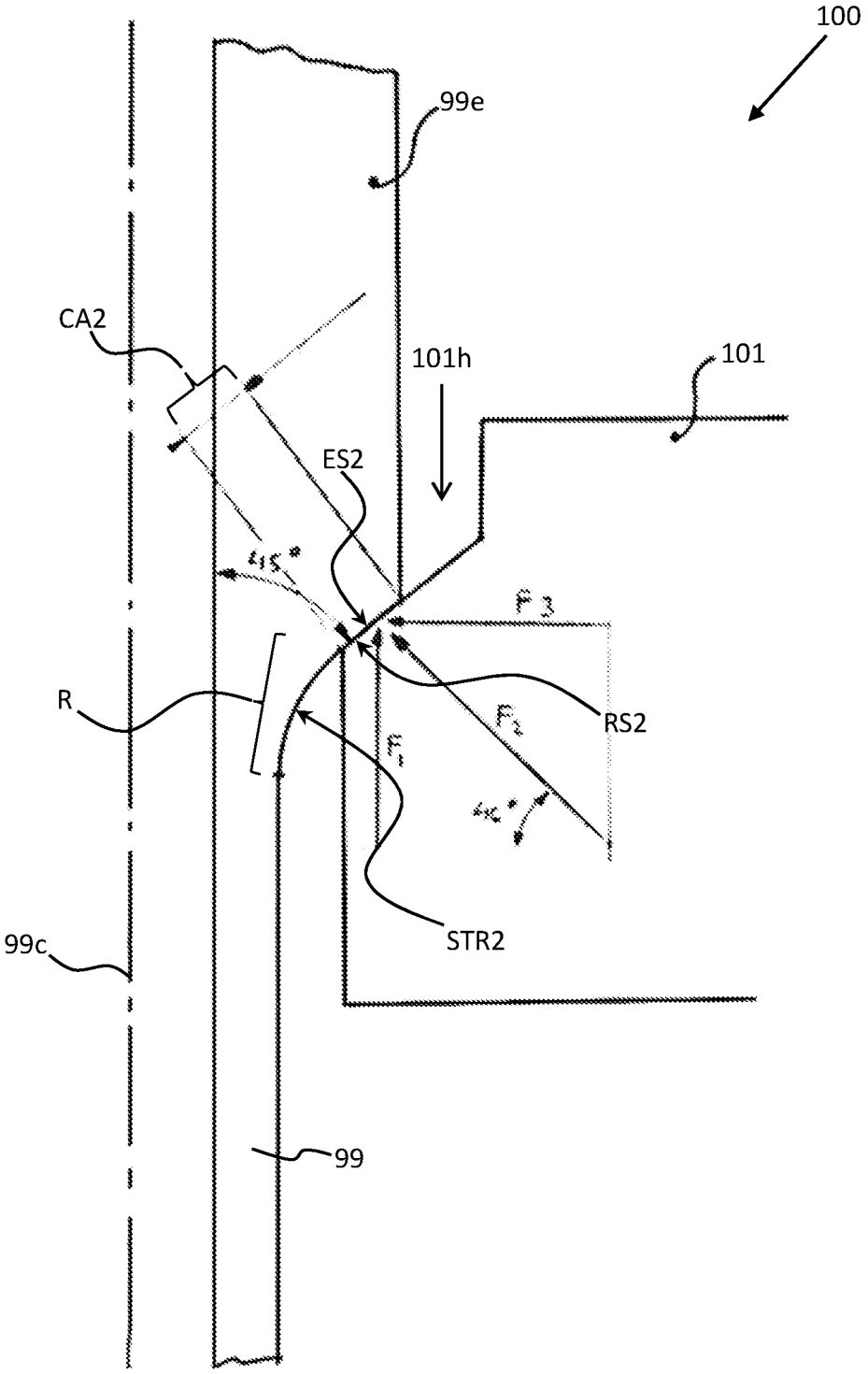
Fig. 6 (PRIOR ART)
FIG. 6 shows an inferior solution to the problem of FIG. 5 as known from the prior art.

FIG. 6 shows an inferior solution to the problem of the structure described with reference to FIG. 5 above. In this solution, the conicity (taper angle) of the frustoconical part of the end portion of the end portion 99*e* of the drill pipe 99 is set to 45 degrees. A consequence of this is a reduced contact area CA2 due to a reduced receiving surface RS2 and a reduced engagement surface ES2 of the end portion 99*e* as illustrated. This is also because of a larger transition region R with an enlarged transition region surface STR2 as illustrated. As far as the forces are concerned there is significant improvement. The contact force F2 is now only a 1/sin 45°=1.41 times the upward-directed force F1 and the crushing force F3 is the same as the upward-directed force. However, the strongly reduced contact area CA2 causes excessive stresses in the elevator bushing. This could be solved by make a smaller transition region R, following a curvature with a smaller radius, but that would then increase the stresses in the transition region, which may adversely affect lifetime of the pipe due to fatigue.

Figure 7:
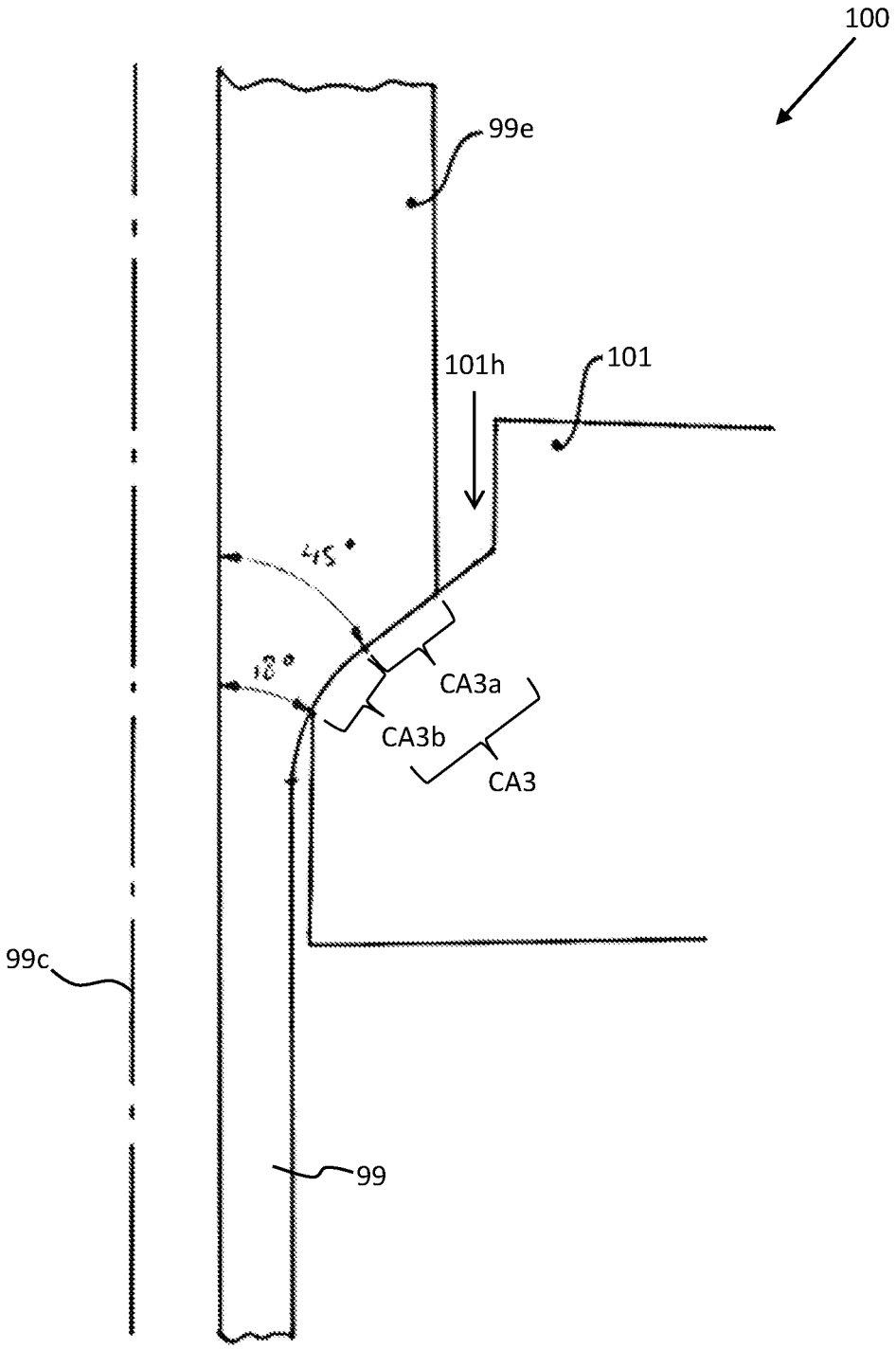
FIG. 7 shows an embodiment of the elevator and corresponding pipe in accordance with the disclosure.

FIG. 7 shows an embodiment of the elevator 100 and corresponding pipe 99 in accordance with the disclosure. The disclosure resides in a redesign of the interface between the elevator (bushing) 101 and the pipe 99. The contact area CA3 is now enlarged because it comprises of two parts, namely a first part CA3*a* that is frustoconically-shaped having a first conicity/first taper angle (here 45 degrees), and a second part CA3*b* that is thoroïde-shaped gradually transitioning from the first conicity (first taper angle) to a second conicity/second taper angle (here 18 degrees). Alternatively, the second part CA3*b* might also be frustoconically-shaped, but then with a smaller conicity then the first part CA3*a*. This will substantially reach the same effect. However, the stresses at the transitions will be larger.

Figure 8:
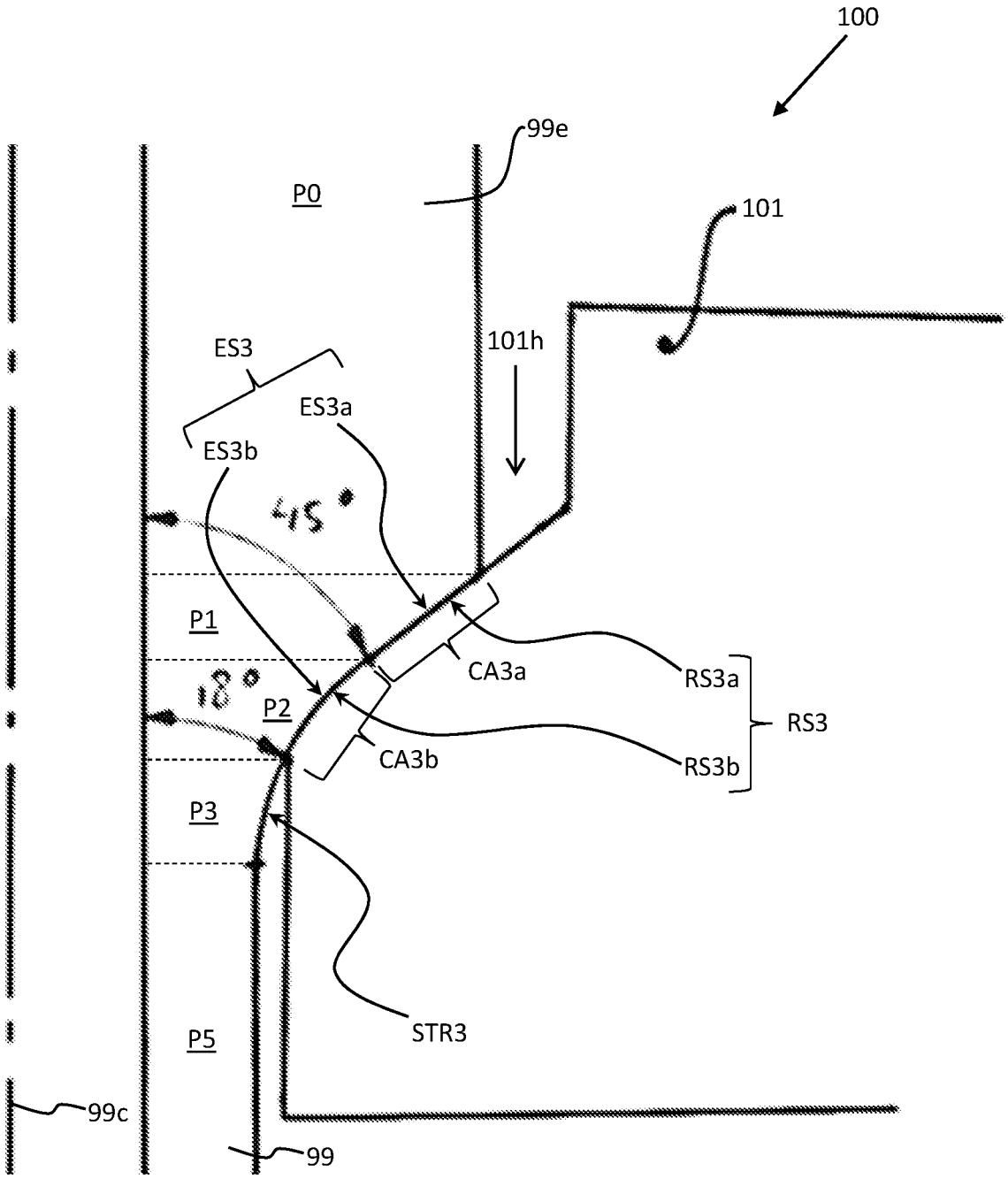
FIG. 8 shows a zoom view of part of FIG. 7 in order to illustrate some further aspects of the disclosure.

FIG. 8 shows an enlarged view of part of FIG. 7 in order to illustrate some further aspects of the disclosure. This figure more clearly illustrates that the drill pipe 99 effectively comprises a cylindrical end part P0 of the end portion 99*e* of the drill pipe 99, a frustoconically-shaped part P1 neighbouring the cylindrical end part P0, a thoroïde-shaped part P2 adjacent the frustoconically-shaped part P1, a transition part P3 neighbouring the thoroïde-shaped part P2 and a cylindrical middle part P5 of the drill pipe 99, as illustrated. The frustoconically-shaped part P1 defines the first part of the engagement surface ES3*a*. The thoroïde-shaped part P2 defines the second part of the engagement surface ES3*b*. The elevator bushing 101 on its turns has sidewalls corresponding with sidewalls of the end portion of the drill pipe 99. The frustoconically-shaped part P1 defines the first part of the receiving surface RS3*a*. The thoroïde-shaped part P2 defines the second part of the receiving surface ES3*b*. The result of the two-part feature of the both the sidewalls of the elevator bushing 101 and the end portion 99*e* of the drill pipe 99 is that the corresponding total receiving surface RS3 of the elevator bushing 101 is enlarged as well as the total engagement surface ES3 of the end portion 99*e* of the drill pipe 99. Another consequence is that the transition region surface STR3 of the transition part P3 is also much smaller, because of the much smaller opening angle of 18 degrees in the current example.

This disclosure in the example of FIGS. 7 and 8 extends the contact area CA3 between the drill pipe elevator shoulder and the elevator bushing 101 by engaging the portion of the radius.

The elevator bushing 101 would follow the shape of the radius until it reaches the point where a tangent line forms an angle of 18° with the main axis of the pipe. This minimum contact angle of 18° is provided to prevent the pipe 99 from becoming stuck in the elevator 100 due to friction between the contact surface of the pipe 99 and the contact surface on the elevator.

The amount of friction depends on various operating conditions such as the presence of drilling mud or pipe dope on the contact surfaces. The magnitude of the friction is determined by the so-called coefficient of friction (COF). The typical COF for drill pipe contact surfaces typically lies between 0.08 (for well lubricated surfaces) and 0.25 for dry metal conditions.

The COF can be translated to a so-called friction angle (Af) through the formula: Af=arctan(COF). In the worst-case scenario of a COF=0.25, the friction angle is 14°. As long as the above-described minimum pipe contact angle of 18° is larger than this 14° friction angle, so the pipe will not get stuck in the elevator due to friction.

Thus, the required elevator capacity for CWOR and LS applications can be reached by (1) reducing the hoop stresses in drill pipe and balancing them with the axial stresses, (2) extending the contact area between the drill pipe elevator shoulder and the elevator bushing, (3) and keeping the 1.5" radius and the tool joint OD unchanged.

Figure 9:
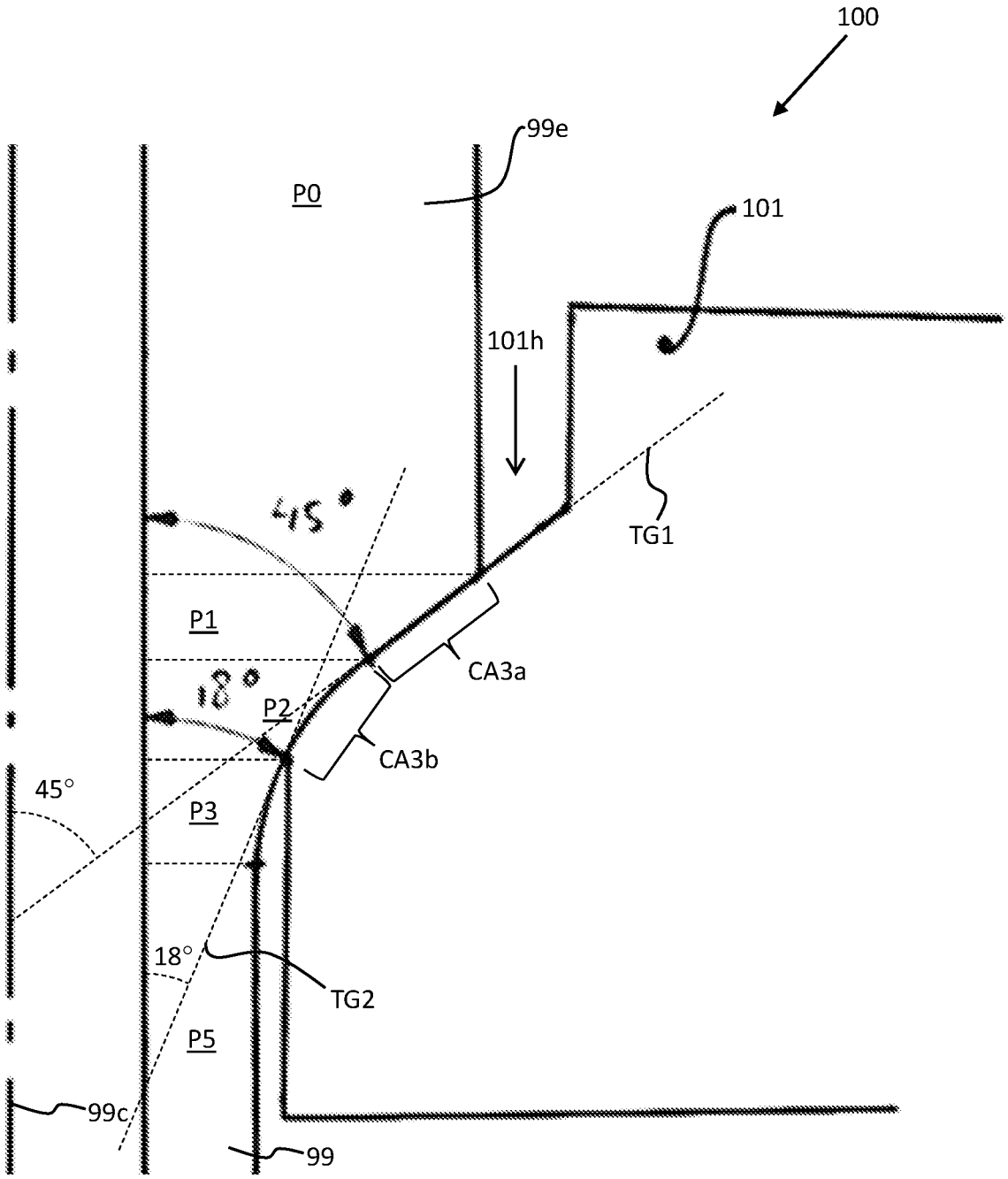
FIG. 9 shows some further aspects of the zoom view of part of FIG. 7.

FIG. 9 shows some further aspects of the enlarged view of part of FIG. 7. This figure serves to illustrate what is meant with the respective conicities (or taper angles). In the figure a first tangent TG1 associated with the first part CA3*a* (frustoconically-shaped) of the contact area CA3 is drawn including the 45° angle it makes with the centreline 99*c* of the pipe 99. The second part CA3*b* (thoroïde-shaped) clearly has many different conicities as it smoothly transitions from the first conicity to the second conicity. The second conicity is defined by the illustrated second tangent TG2 at the transition point from the second part P2 to the third part P3 (which forms an edge on the elevator 100 as illustrated).

Figure 10:
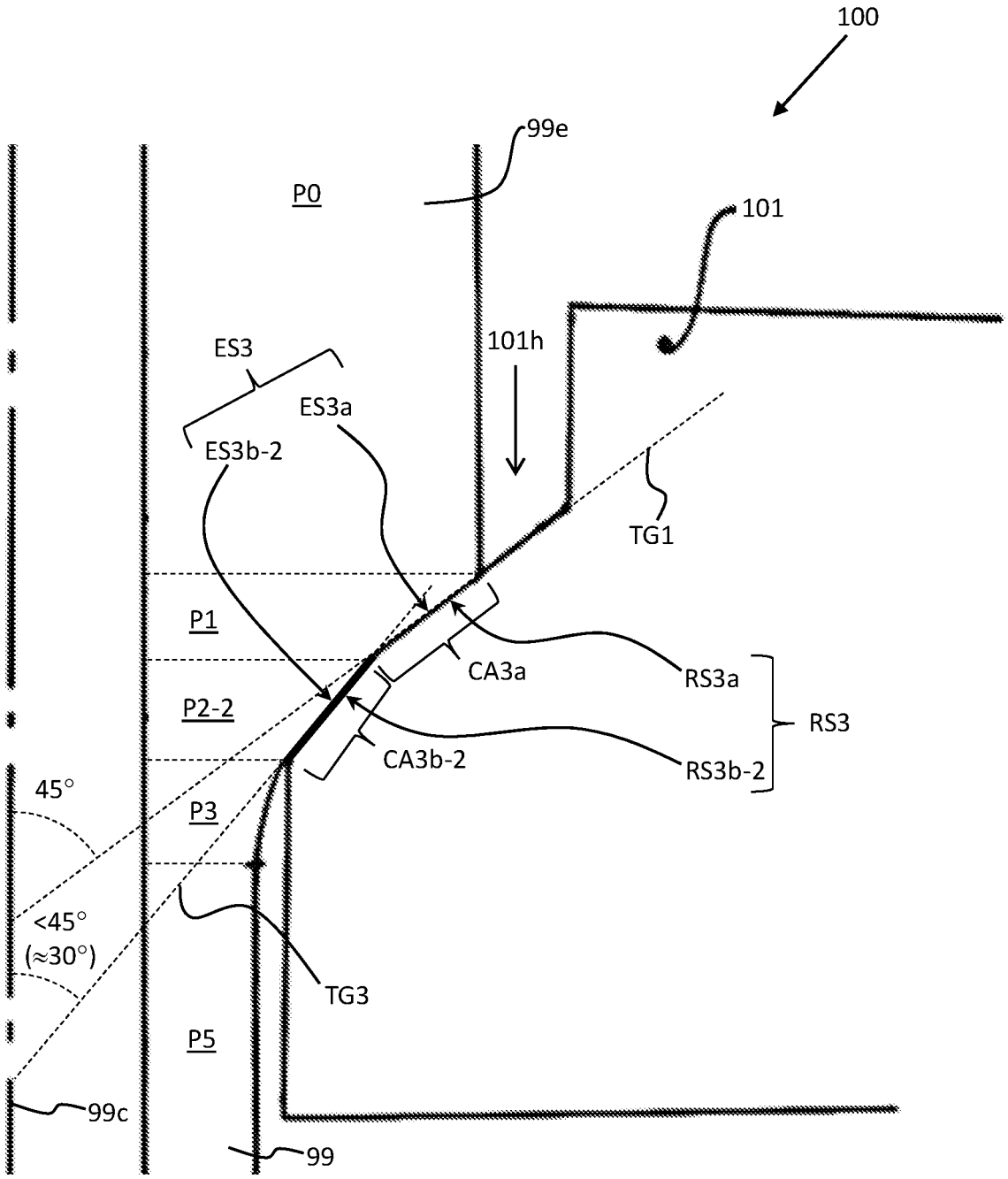
FIG. 10 shows a pipe and a matching elevator in accordance with a further embodiment of the disclosure.

FIG. 10 shows a pipe 99 and a matching elevator 100 in accordance with a further embodiment of the disclosure. This embodiment will only be discussed in as far as it differs from the embodiment of FIG. 8. The main difference is that the thoroïde-shaped second part of the contact area CA3 has been replaced with a further frustoconically-shaped part CA3*b*-2. This is impact on both the shape of the elevator 100 as well as the pipe 99, which now has a second frustoconically-shaped part P2-2 as illustrated. The second part of the engagement surface ES3*b*-2 and the second part of the receiving surface RS3*b*-2 are correspondingly shaped. The figure also illustrates a further tangent TG3 of this frustoconically-shaped contact area, which now makes an angle of about 30° with the centreline 99*c*, but it may make any other taper angle between 18° and 45°. All these variations fall within the scope of the disclosure as long as the conicity of the second part is lower than that of the first part.

The particular embodiments disclosed above are illustrative only, as the disclosure may be modified and practiced in different but equivalent manners apparent to those skilled in the art having the benefit of the teachings herein. The disclosure may be applied in drilling, intervention operations, landing string operations, riser operations, and completion operations. As mentioned earlier, the elevator bushing is not an essential feature of the disclosure, the elevator may also go without such bushing and be shaped according to the drawing.

The disclosure covers all these variants as long as they are covered by the independent claims. No limitations are intended to the details of construction or design herein shown, other than as described in the claims below. It is therefore evident that the particular embodiments disclosed above may be altered or modified and all such variations are considered within the scope of the disclosure. Accordingly, the protection sought herein is as set forth in the claims below.

It should be noted that the above-mentioned embodiments illustrate rather than limit the claimed invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. The claimed invention may be implemented by means of hardware comprising several distinct elements, and by means of a suitably programmed computer. In the device claims enumerating several means, several of these means may be embodied by one and the same item of hardware.

The invention claimed is:

1. An elevator for holding an end portion of a pipe in a drill tower, the end portion of the pipe having a minimum diameter, the elevator comprising:

a hole from which, in operational use, the pipe is suspended by an end portion, wherein the hole comprises a minimum diameter that is smaller than the minimum diameter of the end portion of the pipe, and wherein the hole further comprises sidewalls shaped with a receiving surface for receiving correspondingly-shaped sidewalls of the end portion of the pipe; and wherein the receiving surface comprises a first part and a second part neighbouring the first part, the first part defining a frustoconical shape having a non-zero first taper angle, and the second part defining a shape having at least partially a non-zero second taper angle less than the first taper angle.

2. The elevator according to claim 1, wherein the first taper angle is such that sidewalls, in operational use, make an angle with a centreline of the pipe between 30 degrees and 60 degrees.

3. The elevator according to claim 2, wherein the second part of the receiving surface defines a further frustoconical shape.

4. The elevator according to claim 1, wherein the second part of the receiving surface defines a thoroïde shape which transitions from the first taper angle at a side facing the first part to the second taper angle at an opposite side.

5. The elevator according to claim 4, wherein the second taper angle is such that sidewalls, in operational use, at least locally make an angle with a centreline of the pipe between 14 degrees and 30 degrees.

6. The elevator according to claim 1, wherein the second part of the receiving surface defines a further frustoconical shape.

7. The elevator according to claim 6, wherein the second taper angle is such that sidewalls, in operational use, at least locally make an angle with a centreline of the pipe between 14 degrees and 30 degrees.

8. A pipe handler assembly comprising an elevator in accordance claim 1.

9. A drill tower comprising the pipe handler assembly according to claim 8.

10. A pipe handler assembly, comprising:

the elevator of claim 1; and a pipe configured for being suspended from the elevator, the pipe comprising:

an end portion in which the minimum diameter of the end portion is larger than the minimum diameter of the hole of the elevator:

wherein sidewalls of the end portion of the pipe are shaped with an engagement surface for engagement with the sidewalls of the hole of the elevator;

wherein the engagement surface comprises a first part and a second part neighbouring the first part, the first part defining a frustoconical shape having a first taper angle of the engagement surface, and the second part defining a shape having at least partially a second taper angle of the engagement surface less than the first taper angle of the engagement surface.

* * * * *